US006422832B1

(12) United States Patent
Wang

(10) Patent No.: US 6,422,832 B1
(45) Date of Patent: Jul. 23, 2002

(54) AIR PUMP CAPABLE OF INFLATING AND DEFLATING AN INFLATABLE OBJECT INTERCHANGEABLY

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 09/817,116

(22) Filed: Mar. 27, 2001

(51) Int. Cl.[7] ..... F04B 19/00

(52) U.S. Cl. ..... 417/315; 417/239; 417/536; 417/537

(58) Field of Search ..... 417/315, 239, 417/536, 537

(56) References Cited

U.S. PATENT DOCUMENTS 207,891 A * 9/1878 Peterson ..... 417/537
1,029,476 A * 6/1912 Peters ..... 417/454
1,319,755 A * 10/1919 Keating ..... 137/625.41
4,334,839 A * 6/1982 Flagg ..... 417/536
5,156,538 A * 10/1992 Lee ..... 417/236
5,360,321 A * 11/1994 Benckert et al. ..... 137/625.18
6,299,420 B1 * 10/2001 Saputo et al. ..... 417/527

* cited by examiner

*Primary Examiner*—Charles G. Freay
*Assistant Examiner*—Emmanuel Sayoc
(74) *Attorney, Agent, or Firm*—Browdy and Neimark, P.L.L.C.

(57) ABSTRACT

An air pump is capable of inflating and deflating an inflatable object and is formed of a main body having a cylinder duct, an air outlet and an air inlet in communication with the cylinder duct. The air in the cylinder duct is let out via the air outlet. The atmospheric air is let into the cylinder duct via the air inlet. Two check valves are disposed respectively at the air outlet and the air inlet. A compressing member has a piston which is movably disposed in the cylinder duct of the main body. An adjustment member is pivoted to the main body such that the adjustment member is displaced between a first position and a second position, so as to enable the adjustment member to be in communication with the air outlet or the air inlet to bring about the inflating function or the deflating function.

7 Claims, 5 Drawing Sheets

AIR PUMP CAPABLE OF INFLATING AND DEFLATING AN INFLATABLE OBJECT INTERCHANGEABLY

FIELD OF THE INVENTION

The present invention relates generally to an air pump, and more particularly to an air pump which is provided with means to inflate and deflate an inflatable object interchangeably.

BACKGROUND OF THE INVENTION

An inflatable object, such as tire, ball, or the like, has a specified inflation requirement. If the inflatable object is inadvertently overinflated by a conventional air pump, the excess air is let out by first disengaging the air nozzle of the air pump with the inflation valve of the inflatable object. In the event that the inflatable object is overdeflated, the inflatable object must be once again inflated by first engaging the air nozzle of the air pump with the inflation valve of the inflatable object. Such a repeated action of inflation and deflation is often a source of annoyance for the conventional air pump user. In addition, the inflation valve of the inflatable object and the air nozzle of the conventional air pump are susceptible to damage or wear under such circumstance as described above.

SUMMARY OF THE INVENTION

The primary objective of the present invention is to provide an air pump which is free of the deficiencies of the conventional air pump described above.

In keeping with the principle of the present invention, the foregoing objective of the present invention is attained by the air pump comprising a main body, two check valves, a compressing member, and an adjustment member. The main body is provided in the interior thereof with a cylinder duct, an air outlet in communication with the cylinder duct, and an air inlet in communication with the cylinder duct. The compressing member has a piston which is movably disposed in the cylinder duct. The adjustment member has a first connection port and a second connection port in communication with the first connection port. The adjustment member is pivoted to the main body such that the adjustment member swivels between a first position and a second position. When the adjustment member is located at the first position, the first connection port of the adjustment member is in communication with the air outlet of the main body. When the adjustment member is swiveled to locate at the second position, the first connection port of the adjustment member is in communication with the air inlet of the main body.

DETAILED DESCRIPTION OF THE INVENTION

Figure 1:
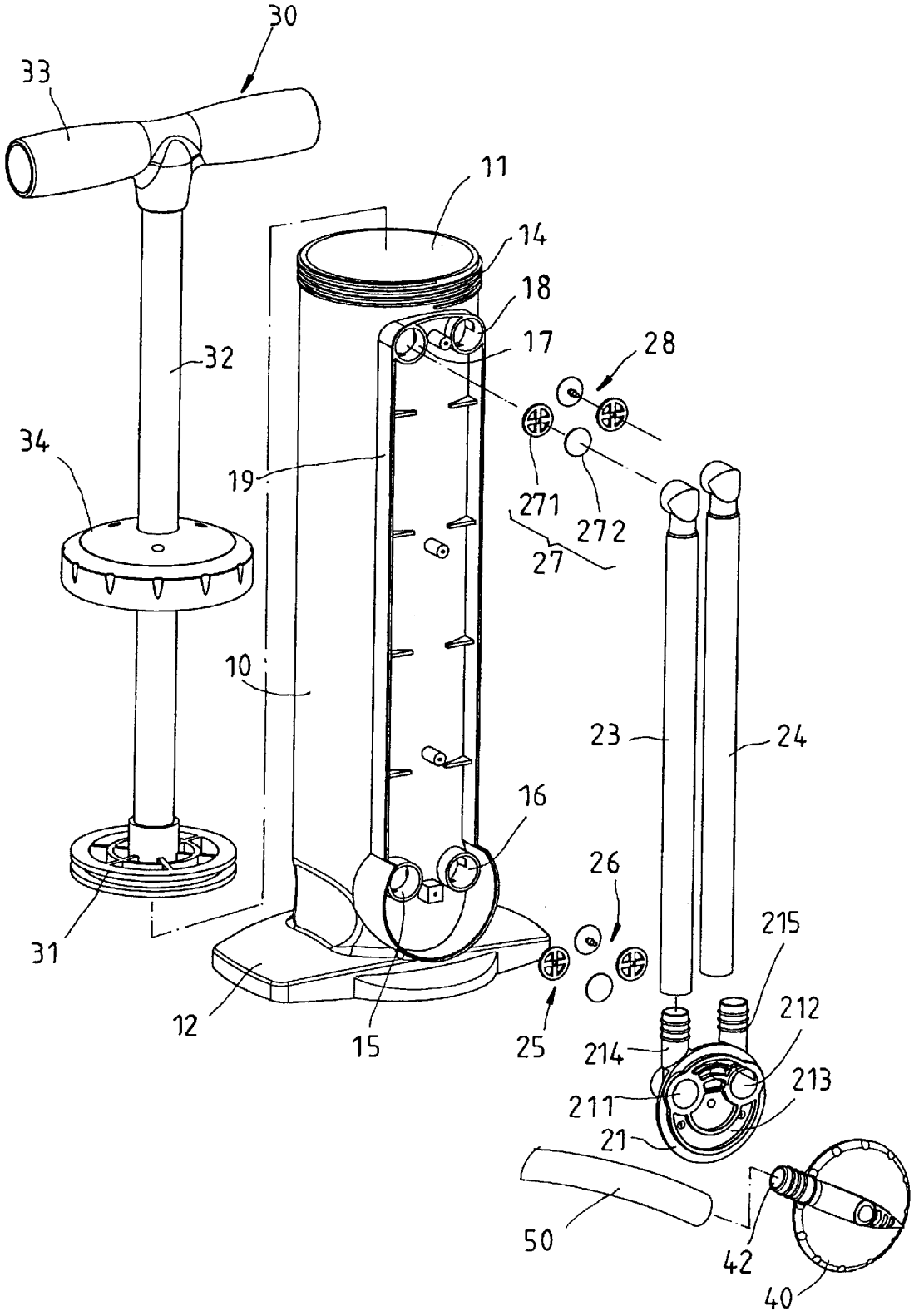
FIG. 1 shows an exploded view of the present invention.

As shown in FIG. 1, an air pump embodied in the present invention is formed of a main body 10, four check valves 25–28, a base 21, an air discharging tube 23, an air admitting tube 24, a compressing member 30, an adjustment member 40, and a hose 50.

The main body 10 is of a cylindrical construction and is provided in the interior with a cylinder duct 11. The main body 10 has a bottom base 12 which is made integrally with the main body 10 for resting the main body 10 on a surface. The main body 10 further has an open top which is provided with outer threads 14. The main body 10 is provided with an air outlet 15 and an air inlet 16, which are located in proximity of the base 12. The main body 10 is further provided with a second air outlet 17 and a second air inlet 18, which are in communication with the cylinder duct 11.

The check valves 25–28 are similar in construction. For this reason, only one check valve 27 is described here. The check valve 27 has a base 271 and a film 272 mounted on the base 271 to allow one way passage of air. These structures are prior art structures. Two check valves 25 and 27 are respectively disposed at the air outlet 15 and the second air outlet 17, so as to allow air in the cylinder duct 11 to be discharged via the air outlet 15 or the second air outlet 17. The valves 26 and 28 are disposed respectively at the air inlet 16 and the second air inlet 18 to allow air to flow into the cylinder duct 11 of the main body via the inlet 16 or the second air inlet 18.

The base 21 is of a disklike construction and is provided with a first connection port 211 and a second connection port 212. The base 21 is further provided in the outer side with an arcuate guide groove 213, and in the inner side with a first manifold 214 and a second manifold 215, which extend uprightly and are in communication with the first connection port 211 and the second connection port 212 respectively. The base 21 is fixed on the main body 10 such that the first connection port 211 of the base 21 is in communication with the air outlet 15 of the main body 10, and that the second connection port 212 of the base 21 is in communication with the air inlet 16 of the main body 10.

The air discharging tube 23 is connected at one end with the second air outlet 17 of the main body 10, and at other end with the first manifold 214 of the base 21.

The air admitting tube 24 is connected at one end with the second air inlet 18 of the main body 10, and at other end with the second manifold 215 of the base 21.

The compressing member 30 comprises a piston 31, a shaft 32, a handle 33, and a cover 34. The shaft 32 is used to connect the piston 31 with the handle 33. The piston 31 is movably disposed in the cylinder duct 11 such that the piston 31 is moved up and down in the cylinder duct 11 by the handle 33. The cover 34 is engaged with the outer threads 14 of the top of the main body 10 for sealing off the open top of the cylinder duct 11, thereby making the cylinder duct 11 airtight. The cylinder duct 11 is divided by the piston 31 into a first air chamber 111 and a second air chamber 112. The first air chamber 111 is located under the piston 31. The second air chamber 112 is located over the piston 31. The air outlet 15 and the air inlet 16 are in communication with the first air chamber 111 of the cylinder duct. The second air outlet 17 and the second air inlet 18 are in communication with the second air chamber 112 of the cylinder duct 11.

Figures 2, 3:
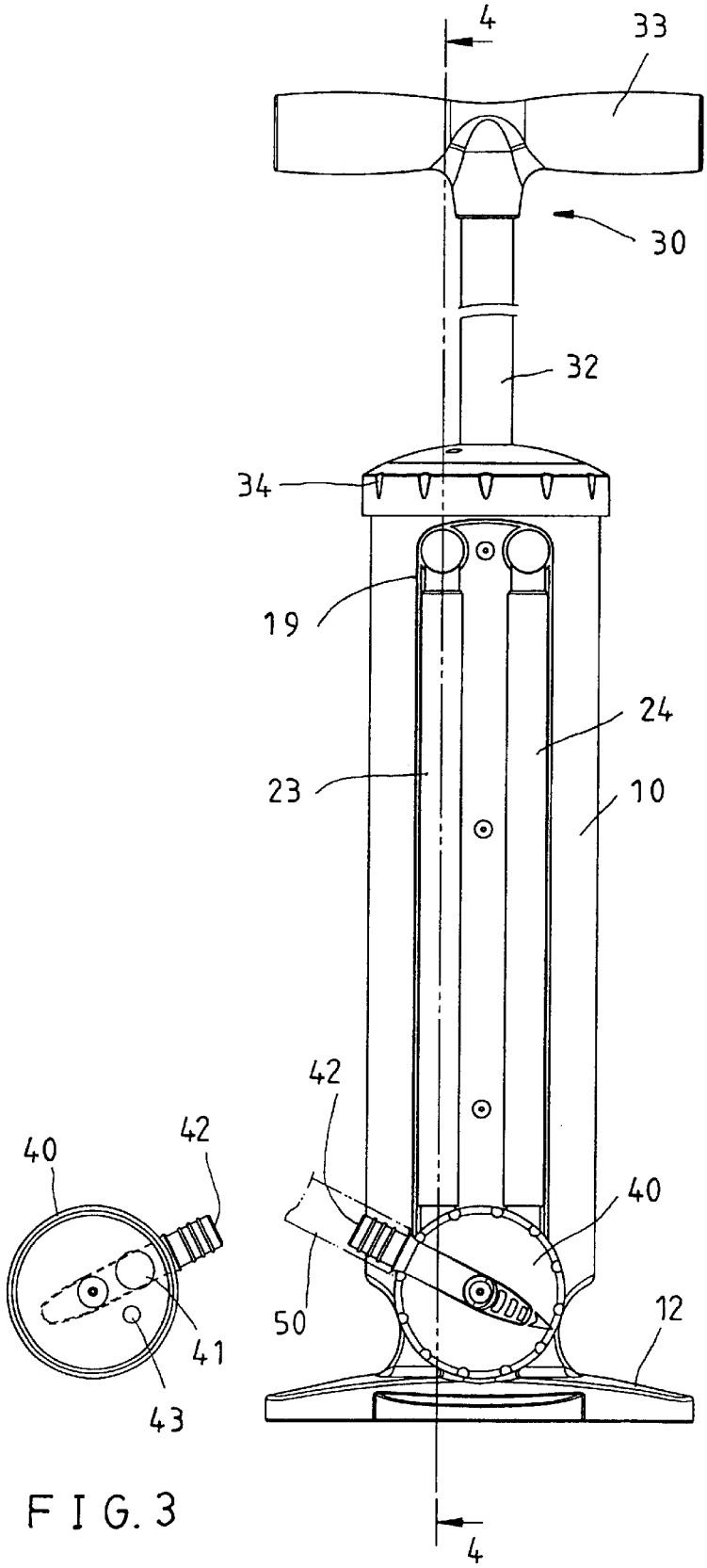
FIG. 2 shows a rear view of the adjustment member of the present invention.
FIG. 3 is a front view of the present invention to show that the adjustment member is located at the first position.
Figure 6:
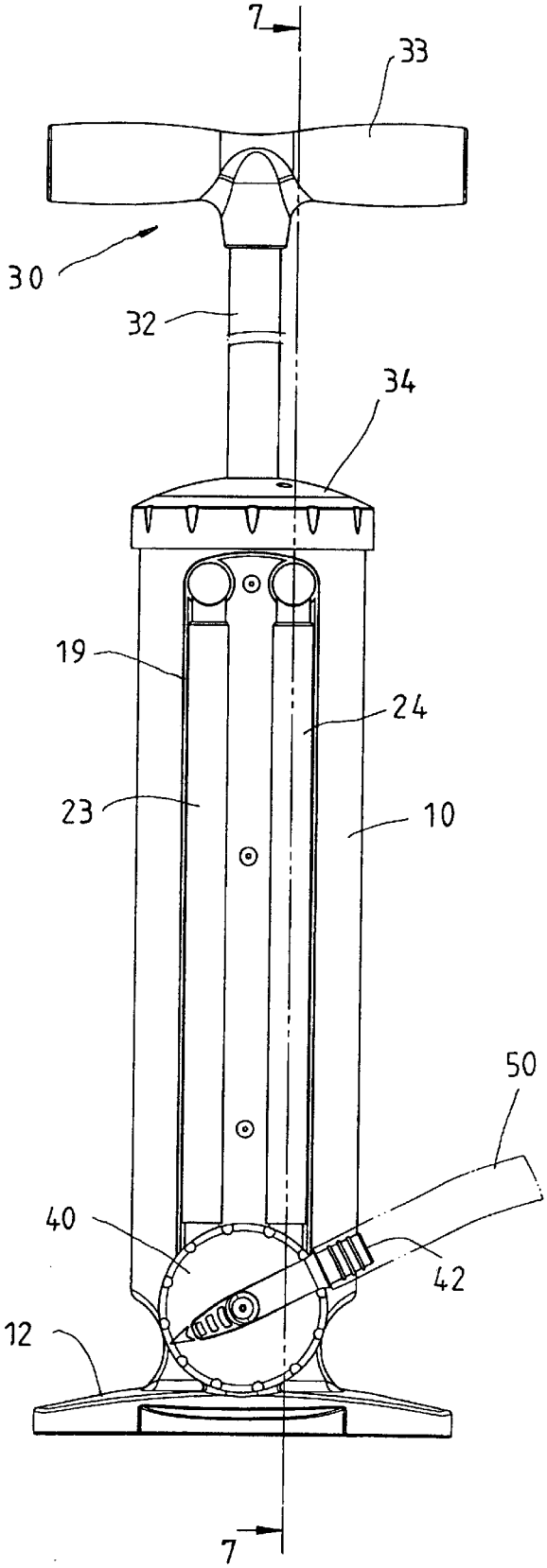
FIG. 6 is a front view of the present invention to show that the adjustment member is located at the second position.

The adjustment member 40 is of a disklike construction and is provided in the internal side with a first through opening 41 and a slide block 43, and in the external side with a second through opening 42 in communication with the first through opening 41, as shown in FIG. 2. The adjustment member 40 is pivoted to the base 21 such that the slide block 43 of the adjustment member 40 is received in the guide slot 213 of the base 21, and that the adjustment member 40 is swiveled between a first position and a second position. When the adjustment member 40 is swiveled by an external force to locate at the first position, as shown in FIG. 3, the first through opening 41 of the adjustment member 40 is in communication with the first connection port 211 of the base 21. When the adjustment member 40 is swiveled to locate at the second position, as shown in FIG. 6, the first through opening 41 of the adjustment member 40 is in communication with the second connection port 212 of the base 21.

The hose 50 is connected at one end to the second through opening 42 of the adjustment member 40, and at other end to an air nozzle (not shown in the drawing) engageable with the inflation valve of an inflatable object.

Figure 4:
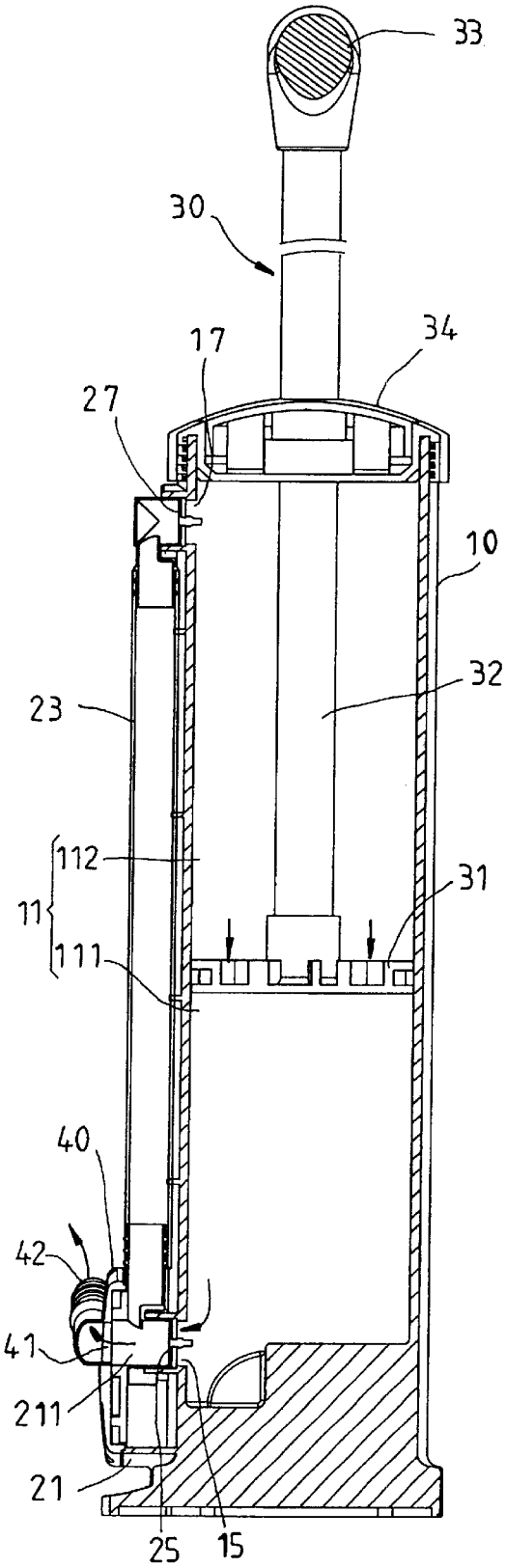
FIG. 4 is a sectional view taken along a line 3—3 as shown in FIG. 3 to show an inflation air current path.

In operation, the air nozzle is engaged with the inflation valve of the inflatable object. Thereafter, the adjustment member 40 is swiveled to the first position before the compressing member 30 is pressed downward by a user's hands holding the handle 33. Now referring to FIG. 4, the air in the first air chamber 111 of the main body 10 is forced out via the air outlet 15 of the main body 10. In the meantime, atmospheric air is let into the second air chamber 112 of the main body 10 via the second connection port 212 of the base 21, the air admitting tube 24, and the second air inlet 18. The air current is then guided into the inflatable object via the first connection port 211 of the base 21, the first through opening 41 and the second through opening 42 of the adjustment member 40, as indicated by arrows in FIG. 4.

Figure 5:
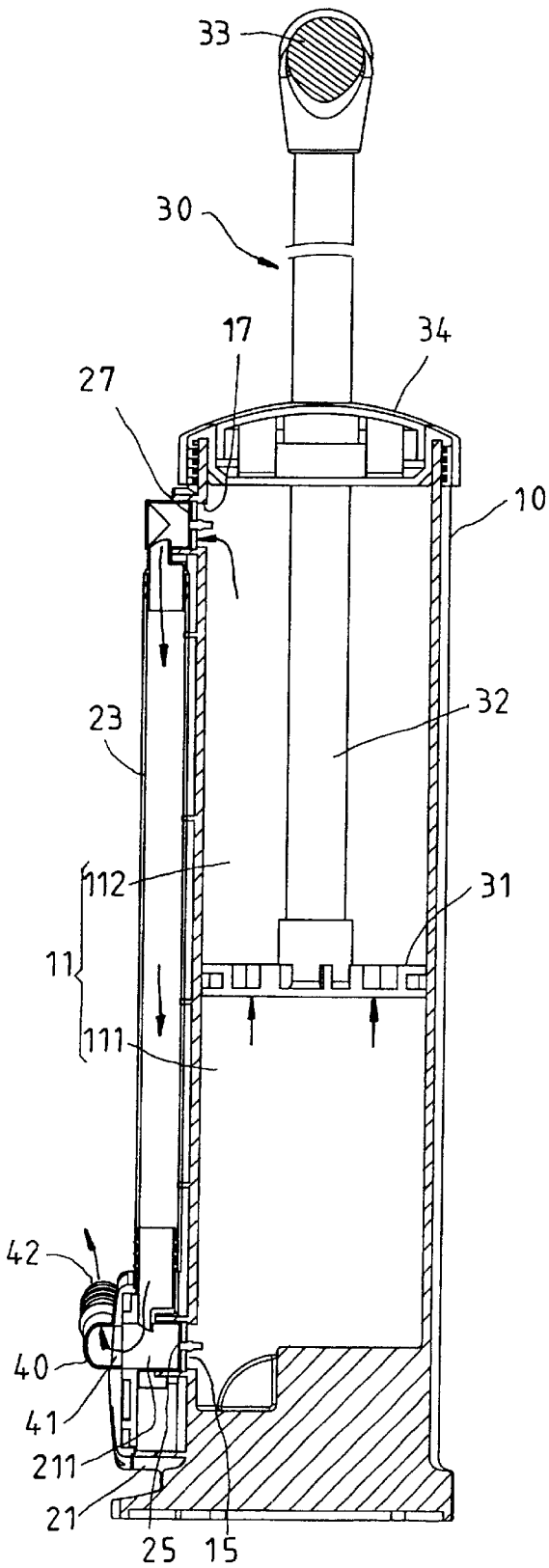
FIG. 5 is a sectional view taken along the line 3—3 as shown in FIG. 3 to show another inflation air current path.

As illustrated in FIG. 5, when the compressing member 30 is pulled upwards, the air in the second air chamber 112 of the main body 10 is discharged via the second outlet 17 of the main body 10. In the meantime, the atmospheric air is drawn into the first air chamber 111 of the main body 10 via the second connection port 212 of the base 21 and the air inlet 16 before flowing into the inflatable object via the discharging tube 23, the first manifold 214 of the base 21, the first through opening 41 and the second through opening 42 of the adjustment member 40, and the hose 50.

Figure 7:
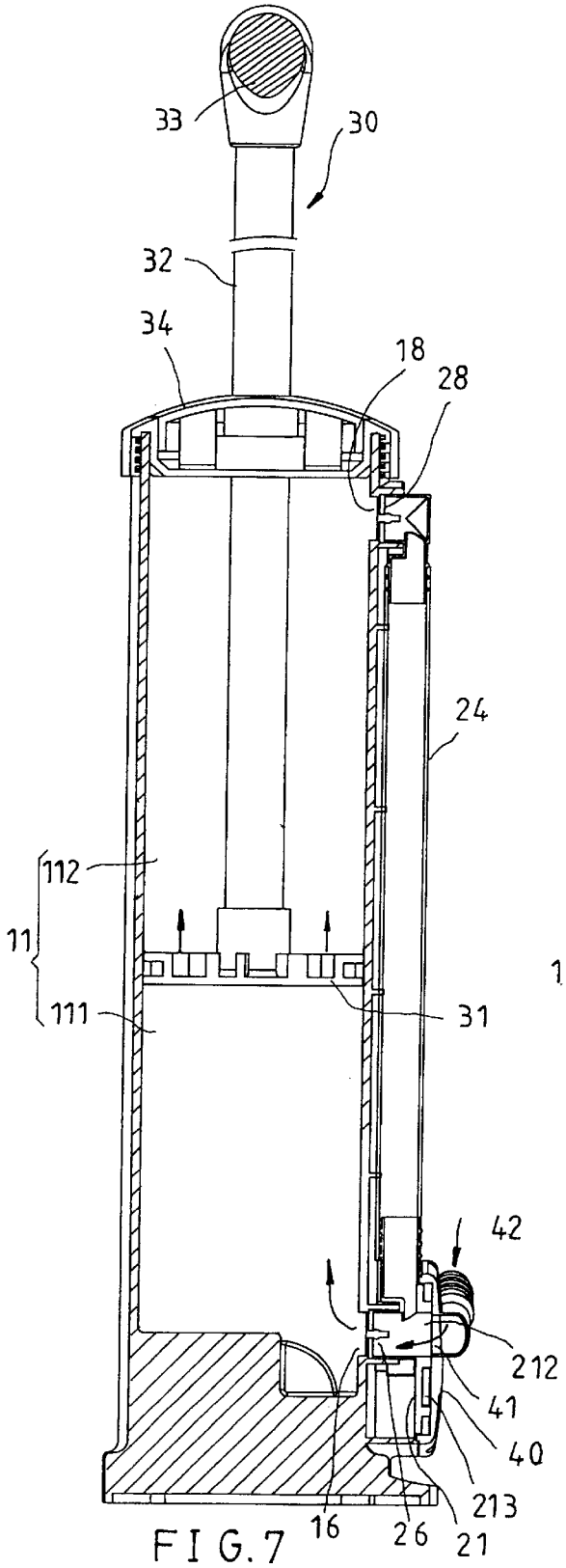
FIG. 7 is a sectional view taken along a line 6—6 as shown in FIG. 6 to show a deflation air current path.

The overinflated object may be deflated by turning the adjustment member 40 to locate at the second position before pulling the compressing member 30 upwards, as shown in FIG. 7. The space in the first air chamber 111 of the main body 10 is enlarged. As a result, the air in the overinflated object is drawn into the first air chamber 111 of the main body 10 via the hose 50, the second through opening 42 and the first through opening 41 of the adjustment member 40, the second connection port 212 of the base 21, and the air inlet 16, as shown by arrows in FIG. 7.

Figure 8:
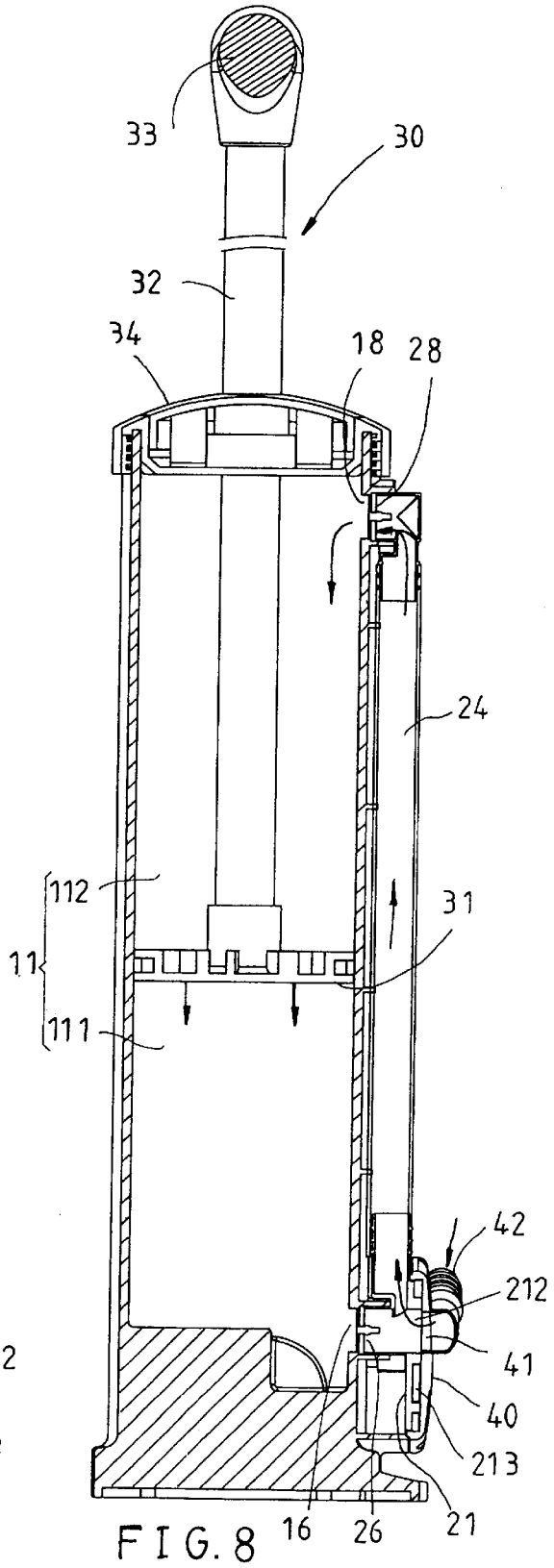
FIG. 8 is a sectional view taken along the line 6—6 as shown in FIG. 6 to show another deflation air current path.

As shown in FIG. 8, when the compressing member 30 is pushed downward, the air in the object is drawn into the second air chamber 112 of the main body 10 via the hose 50, the second through opening 42 and the first through opening 41 of the adjustment member 40, the second manifold 214 of the base 21, the discharging tube 24, and the second air inlet 18, as shown by arrows in FIG. 8.

It is therefore readily apparent that the inflating and the deflating functions of the present invention are simply attained by adjusting the position of the adjustment member 40 and by pulling upward or pushing downward the compressing member 30. The removal of excess air in the inflatable object is done without disengaging the air nozzle of the air pump with the inflation valve of the inflatable object. The air pump of the present invention is suitable for use in removing the residual air in a deflated air mattress to facilitate the storage of the air mattress.

The main body of the present invention is provided with an annular bay 19 circumventing the air discharging tube 23 and the air admitting tube 24, as well as the base 21 and the adjustment member 40. The annular bay 19 serves to provide them with protection against damage by the external force.

The adjustment member 40 may be displaced between the first position and the second position, which are located linearly.

The present invention may be used to inflate and deflate an inflatable object by pushing the compressing member provided that the present invention is devoid of the second air outlet 17, the second air inlet 18, the air discharging tube 23, the air admitting tube 24, and the airtight effect of the cover 34.

What is claimed is:

1. An air pump capable of inflating and deflating an inflatable object interchangeably, said air pump comprising:

a main body of a long columnar body and having a bottom base, a cylinder duct, an air outlet, and an air inlet, said bottom base being located at one end of said main body to enable said main body to be rested on a surface, said cylinder duct being located in an interior of said main body, said air outlet and said air inlet being located at a predetermined position of an external side of said main body such that said air outlet and said air inlet are in communication with said cylinder duct;

a compressing member formed of a handle, a piston, and a connection rod connecting said handle with said piston, said piston being movably disposed in said cylinder duct of said main body such that said piston moves back and forth in a predetermined range, and that said piston divides said cylinder duct into a first air chamber and a second air chamber, said first air chamber being in communication with said air outlet and said air inlet;

two check valves disposed respectively at said air inlet and said air outlet, so as to enable air to enter said first air chamber via said air inlet, and to enable air in said first air chamber to be discharged via said air outlet;

an adjustment member having a first connection port and a second connection port in communication with said first connection port, said adjustment member being pivoted to said main body such that said adjustment member is displaced between a first position and a second position, said first connection port of said adjustment member being in communication with said air outlet of said main body at such time when said adjustment member is located at said first position, said first connection port being in communication with said air inlet of said main body at such time when said adjustment member is located at said second position; and a hose fastened at one end thereof to said second connection port of said adjustment member.

2. The air pump as defined in claim 1, wherein said main body further comprises a base which is provided with a first through opening corresponding in location to said air outlet of said main body, and a second through opening corresponding in location to said air inlet of said main body;

wherein said adjustment member is pivoted to said base; wherein said first connection port of said adjustment member is corresponding to said first through opening of said base at the time when said adjustment member is located at said first position, said first connection port of said adjustment member being corresponding to said second through opening at the time when said adjustment member is located at said second position.

3. The air pump as defined in claim 2, wherein said base or said adjustment member is provided with a guide slot or a slide block which is received in said guide slot, so as to enable said adjustment member to be displaced between said first position and said second position.

4. The air pump as defined in claim 1, wherein said main body further comprises a second air inlet and a second air outlet, which are in communication with said second air chamber of said main body; wherein said two check valves are respectively disposed at said second air inlet and said second air outlet, so as to enable air to enter said cylinder duct of said main body via said second air inlet, and to enable air in said cylinder duct of said main body to be discharged via said second air outlet, said second air inlet being connected with said air inlet by an air admitting tube, said second air outlet being connected with said air outlet by an air discharging tube.

5. The air pump as defined in claim 4, wherein said main body is provided with an annular bay circumventing said air admitting tube, said air discharging tube, and said adjustment member.

6. The air pump as defined in claim 1, wherein said adjustment member is turned a predetermined angle between said first position and said second position.

7. The air pump as defined in claim 1, wherein said adjustment member is displaced linearly between said first position and said second position.

* * * * *